United States Patent [19]

Siebrecht-Reuter

[11] 4,238,987

[45] Dec. 16, 1980

[54] EXPANSION DOWEL FOR SPACED MOUNTING OF PARTS ON A SUPPORT STRUCTURE

[75] Inventor: Gerd Siebrecht-Reuter, Deutenhausen, Fed. Rep. of Germany

[73] Assignee: Hilti Aktiengesellschaft, Schaan, Liechtenstein

[21] Appl. No.: 936,919

[22] Filed: Oct. 25, 1978

[30] Foreign Application Priority Data

Aug. 31, 1977 [DE] Fed. Rep. of Germany ..... 2739235

[51] Int. Cl.[3] ..... E04B 1/38; F16B 13/04

[52] U.S. Cl. ..... 85/83; 52/508; 52/513; 52/698

[58] Field of Search ..... 85/1.5 R, 1 L, 5 P, 85/7, 32 V, 33, 36, 69, 82, 83, 84; 52/383, 508, 513, 698

[56] References Cited

U.S. PATENT DOCUMENTS

| | | | |
|---|---|---|---|
| 2,040,917 | 5/1936 | Briskin | 85/36 |
| 2,454,223 | 11/1948 | Shippfe | 85/5 P UX |
| 3,450,427 | 6/1969 | Fischer | 52/513 |
| 3,471,183 | 10/1969 | Fischer | 85/83 X |
| 3,938,587 | 2/1976 | Vian | 85/7 X |
| 4,028,857 | 6/1977 | Fischer | 52/508 |

FOREIGN PATENT DOCUMENTS

| | | | |
|---|---|---|---|
| 2457499 | 6/1976 | Fed. Rep. of Germany | 85/84 |
| 2289794 | 5/1976 | France | 85/1 L |
| 629216 | 9/1949 | United Kingdom | 85/5 P |
| 985376 | 3/1965 | United Kingdom | 85/36 |
| 1212587 | 11/1970 | United Kingdom . | |
| 307214 | 7/1971 | U.S.S.R. | 85/36 |

*Primary Examiner*—Thomas J. Holko

*Attorney, Agent, or Firm*—Toren, McGeady and Stanger

[57] ABSTRACT

An expansion dowel has an axially extending sleeve-like expansion member with a first portion arranged to be inserted into a bore hole and a second portion arranged to extend axially from the bore hole. A stop member is securable on the second portion for holding a panel or similar part between the stop member and the rear or outer end of the expansion member in spaced relation to the support structure in which the bore hole is formed. The stop member includes a locking member axially displaceable on and securable to the second portion and a supporting member adjustably threadedly engaged with said locking member and positioned between the locking member and the rear end of the expansion member. With the locking member fixed on the second portion, the supporting member can be adjusted for holding the panel or similar part between it and a support surface on the rear end of the expansion member.

7 Claims, 2 Drawing Figures

EXPANSION DOWEL FOR SPACED MOUNTING OF PARTS ON A SUPPORT STRUCTURE

SUMMARY OF THE INVENTION

The present invention is directed to an expansion dowel for mounting a panel or similar part in spaced relation to a support structure containing a bore hole into which the dowel is inserted, such support structure could be a wall or ceiling. Further, the expansion dowel includes a first portion arranged to be inserted into and expanded outwardly within a bore hole in the support structure and a second portion arranged to extend outwardly from the support structure so that it passes through the panel. A stop member is axially adjustably positioned on and securable to the second portion and serves as a support for spacing the panel outwardly from the support structure.

To space a panel outwardly from a support structure, it has been known to use various types of fastening elements. Generally, such fastening elements include a stop for positioning the panel at a spaced distance from the support structure. Usually the panel is held between this stop and an abutment on the fastening element.

One known fastening element includes an expansion dowel having an expanding portion and an axially extending shaft. The expanding portion can be spread by means of a screw extending through the shaft. Displaceable tongues are arranged on the shaft and serve to support the panel outwardly from the structure into which the expanding portion is inserted. The rear or outer end of the shaft has a flange serving as a support shoulder for the panel. Since there is an exact distance between the stop and the support shoulder in this known expansion dowel, the fastening element is suited only for panels whose distance corresponds exactly to the distance between the stop and the shoulder. Accordingly, to fasten panels of different thicknesses it is necessary to provide different fastening elements.

To overcome this disadvantage it has been known to use an expansion dowel which also includes an expanding portion and an axially extending shaft with a flange provided on the rear end of the shaft to form a support shoulder with the flange projecting outwardly from the shaft. Further, the shaft is threaded and a nut is threaded onto it so that the nut serves as a stop for the panel. With this threaded connection on the shaft, the distance between the support shoulder and the stop is variable and the fastening element can be used to mount panels of different thicknesses.

When this last-mentioned fastening element is used, since its shaft has a thread which passes through the panel, the panel must be provided with an opening corresponding to the outer diameter of the thread. Because the thread projects from the shaft, the opening through the panel must be larger than the bore hole receiving the expanding portion of the element. Accordingly, it is not possible to form the opening in the panel and in the support structure with the same tool. Aside from this disadvantage, in this known fastening element, the longitudinal adjustment of the stop provides a problem since, due to the threaded connection, even for only a slight adjustment, a significant number of turns of the threaded nut are required. This feature involves a time-consuming assembly and also somewhat reduced accessibility.

Therefore, the primary object of the present invention is to afford an expansion dowel which is suited for the quick and exact spaced mounting of panels or similar parts of different thicknesses.

In accordance with the present invention, the spaced mounting is afforded by a stop member securable on a second portion of the expansion dowel which projects outwardly from a bore hole receiving a first portion. The stop member includes a locking member securable to the second portion and a supporting member providing a bearing surface for one side of the panel. When the locking member is secured on the second portion of the expansion dowel, the supporting member can be adjusted in the axial direction relative to the locking member.

Based on the present invention, the stop member is made up of two parts and is adjustably positionable in the axial direction of the expansion dowel. The stop member consists of the locking member and the supporting member with the supporting member providing the active support for one side of the panel. The locking member can be secured to the second portion of the expansion dowel in different axially spaced positions. Even when the locking member is secured to the second portion, the supporting member which provides the actual support for the panel, is adjustable to a limited extent relative to the locking member in the axial direction of the dowel. Accordingly, it is possible to locate the stop member in the approximate position for supporting the panel to be spacedly mounted from a wall or ceiling by sliding the stop member in the axial direction of the dowel and then securing the locking member onto the second portion of the dowel. Subsequently, the supporting member which is adjustable relative to the locking member can be axially displaced for any required fine adjustment.

To provide a suitable fine adjustment, it is preferred to threadedly interengage the supporting member and the locking member. By turning the supporting member relative to the locking member secured on the second portion of the expansion dowel, it is possible to adjust the supporting member in the axial direction of the dowel. The thread for interengaging the two members can be trapezoidal, round or of a similar structure. The supporting member can be provided with surfaces, such as flats, for engaging a tool, such as a wrench or the like, for applying torque to the supporting member. Accordingly, a portion of the outer surface of the supporting member can be provided with a hexagonal shape.

There are a number of ways in which the locking member can be secured on the second portion of the expansion dowel. One possibility involves the use of elastic lugs on the locking member which are biased toward the second portion of the dowel due to their elastic character. To assure an adequate securement onto the second portion, the elasticity of the lugs can be implemented with an additional member, for example, a box nut, an adjusting ring or the like. Such additional member can be combined with the supporting member.

Another feature of the invention is to provide the ends of the lugs directed toward the second portion of the expansion dowel with a wedge shape so that automatic engagement takes place when the locking member is secured on the second portion with an approximately form-locking engagement being afforded between the two members. An effective form-locking engagement is provided, in accordance with the present invention, when rack sections formed of a plurality of teeth are provided in the second portion in the region contacted by the lugs on the locking member. The teeth in the rack extend transversely of the axial direction of the expansion dowel. The teeth making up the racks are formed into the surface of the second portion so that the tips of the teeth are flush with the outer surface of the second portion. As a result, the teeth forming the racks will not interfere when the second portion of the dowel is passed through the panel. As a result, the opening through the panel can be made to correspond to the diameter of the second portion. To ensure the effective engagement between the locking member and the second portion of the expansion dowel, projections or grooves can be provided on the second portion or on the inner wall of the locking member which interengage and limit any relative turning of the locking member and the second portion.

Preferably, the racks are formed in a saw-toothed manner with the longer side of each tooth facing toward the first portion of the expansion member which is spread into holding engagement within the bore hole. Accordingly, the locking member can be moved toward the end of the second portion spaced from the first portion by sliding the wedge-shaped elastic lugs over the racks. When the second portion is moved in the opposite direction, however, the ends of the lugs engage between the teeth of the racks and the elasticity of the lugs is sufficient to ensure the desired interengagement.

By securing the locking member on the second portion of the expansion member, a quick approximate locating of the stop member adjacent the panel is achieved by sliding the locking member along with the supporting member over the second portion toward the panel. During such movement, the lugs on the stop member or, more specifically, on the locking member slide over the racks. Subsequent fine adjustment of the supporting member relative to the locking member results in the elastic lugs being fixedly engaged within the racks.

If it is necessary to release the stop member and move it over the second portion in the direction of the expanding first portion, the locking member is turned relative to the first portion until its elastic lugs are displaced out of the recesses between the teeth in the racks and contact the smooth surface of the second portion. In the application of the torque required for turning the locking member relative to the shaft of the expansion dowel, the circumferential surface of the locking member is provided with flats or planar surfaces for the engagement of a suitable tool, such as a wrench or the like. In place of or in addition to such planar surfaces, the locking member can also be provided with a milled or knurled portion so that it can be gripped and turned relative to the first portion of the expansion member when no suitable tool is available. To avoid the possibility of turning the locking member too far so that the lugs will reengage with another rack, it is advantageous to provide the second portion with a stop that interacts with the locking member. Such a stop can be easily combined with the recesses formed in the second portion to ensure the proper engagement of the lugs in the racks. For example, grooves formed in the second portion of the expansion member or in the locking member can extend along a portion of the circumferential surface of either part so that turning of the locking member over the width of a rack and the continued circumferential movement of the second portion is possible until the next rack is approached.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
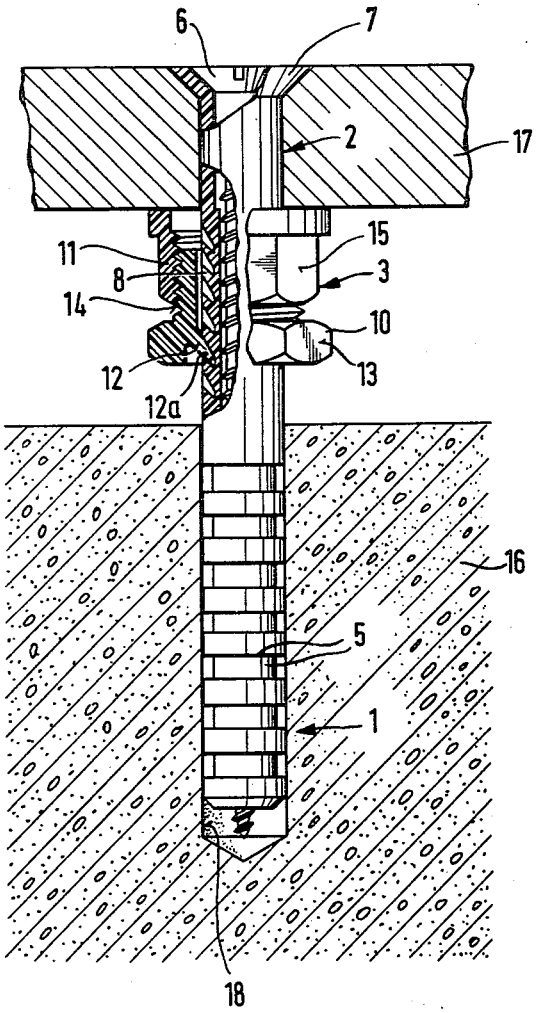
FIG. 1 is a side view, partly in section, of an expansion dowel embodying the present invention and shown inserted into a bore hole in a receiving or support material.
Figure 2:
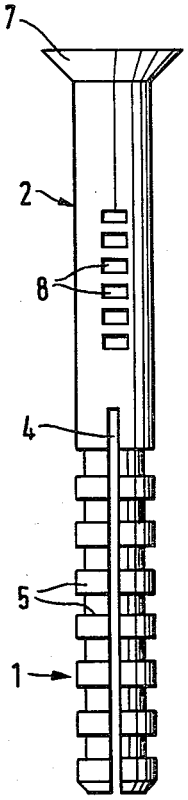
FIG. 2 is a side view of a portion of the expansion dowel shown in FIG. 1 turned by 90° relative to the position shown in FIG. 1.

In FIG. 1 an expansion dowel is illustrated having a first or front end inserted into a bore hole 18 in a support wall 16 while the second or rearward end of the dowel projects outwardly away from the support wall. The expansion dowel is a sleeve-like member and consists of an expanding first portion 1 positioned within the bore hole and a shaft-like second portion 2 extending outwardly from the support wall to the rear end of the dowel. In addition, the dowel includes a stop member 3 positioned on the second portion 2. As shown in FIG. 2, the expanding first portion 1 has a longitudinal slot 4 and a known profiled outer surface 5 which can be spread by an expanding screw 6 which extends through the sleeve-like expanding member from its rear end to its front end. At the rear end of the dowel, the second portion 2 has an outwardly projecting flange 7. As seen best in FIG. 2, the second portion 2 of the dowel has racks extending in the axial direction of the dowel and located intermediate the first portion 1 and the flange 7. In the embodiment shown in the drawing, two racks 8 are provided in the second portion 2 located diametrically opposite one another and the racks are formed so that there are no projections beyond the outer surface of the second portion 2.

As illustrated in FIG. 1, the stop member 3 consists of a locking member 10 and a supporting member 11. Both the locking member and the supporting member have an annular nut-like shape. The inner surface of the locking member 10 has elastic lugs 12 extending inwardly therefrom and the inner ends **12*a* of the lugs are wedge-shaped. The width of the wedge-shaped ends 12*a* of the lugs, that is, the dimension extending in the circumferential direction, corresponds to the circumferential width of the racks 8 so that the ends 12*a* can engage within the recesses formed between the teeth of the racks. Additionally, the outer surface 13 of the locking member 10 is provided with flats for the application of an appropriate tool for applying torque. The locking member 10 and supporting member 11 are interconnected via a thread. The supporting member 11 has a female thread while the locking member 10 has a male thread. By turning the supporting member relative to the locking member, the supporting member can be adjusted in the axial direction of the dowel. Similar to the locking member 10, the outer surface of the supporting member 11** has flats or planar surfaces on which a suitable tool can be engaged for applying torque to the supporting member.

In FIG. 1, a panel 17 is positioned on the expansion dowel in spaced relation to the support wall 16. In mounting the panel, the first portion 1 and the second portion 2 of the expansion dowel are passed through the panel 17 and the stop member 3 with the first portion 1 being anchored into the bore hole 18 in the support wall 16 by screwing the expanding screw 6 into the sleeve-like expanding member. After the first portion of the dowel has been anchored in the bore hole, the stop member 3 is moved toward the panel 17. During such movement, the lugs 12 on the locking member slide over the racks 8 until the desired position is reached and the ends of the lugs seat within recesses in the racks. Subsequently, by turning the supporting member 11 relative to the locking member 10, the panel 17 is securely fixed between the supporting member and the flange 17 and the ends 12 of the lugs are pressed further into the recesses in the racks 8.

In another frequently used arrangement, the assembly shown in the drawings is provided with the panel 17 to be mounted on the support wall 16, secured between the flange 7 and the supporting member 11 before the expansion dowel is inserted and anchored. In this arrangement, the expansion dowel is inserted through the panel 17 and the stop member 3 is moved toward the panel. The panel 17 is secured by turning the supporting member in the manner described above. Finally, the panel 17 along with the expansion dowel is anchored in the bore hole 18 of the support wall 16 by screwing the expanding screw 6 into the sleeve-like body of the dowel.

If it should be necessary to do so, for example, for disassembly, the stop member 3 can be moved away from the panel toward the first portion 1 by simply turning the locking member 10 relative to the shaft 2 so that the lugs 12 are displaced out of the recesses formed by the racks 8 and come into contact with the smooth surface of the second portion so that the stop member can be moved forwardly toward the front end of the dowel. To facilitate the turning of the locking member 10 relative to the second portion 2, the outer surface of the locking member has planar surfaces 13 to be engaged by a suitable tool.

While specific embodiments of the invention have been shown and described in detail to illustrate the application of the inventive principles, it will be understood that the invention may be embodied otherwise without from such principles.

What is claimed is:

1. Expansion dowel assembly for insertion into a bore hole in a support structure for supporting a part in spaced relation from the support structure, comprising an axially elongated sleeve-like expansion member arranged to be inserted into a bore hole and having a front end inserted first into the bore hole and a rear end, said sleeve-like expansion member having a first axially extending portion extending from the front end thereof for a part of the axial length thereof, said first portion arranged to be inserted into and expanded into holding contact with the surface of the bore hole, and a second axially extending portion extending from the rear end of said expansion member for a part of the axial length thereof toward said first portion and arranged to project outwardly from the bore hole, means for expanding said first portion, a stop member secured on said second portion and movably adjustable thereon in the axial direction thereof for holding a part on said second portion between said stop member and the rear end of said expansion member, wherein the improvement comprises that said stop member includes a locking member axially displaceable along and securable to said second portion, and a supporting member mounted on said locking member and being axially adjustable in the direction between said locking member and the rear end of said expansion member so that a part can be supported against said supporting member on the rear end side thereof and held in spaced relation to the support structure containing the bore hole, said supporting member is annularly shaped and is disposed in threaded engagement with said locking member, said locking member is annular in shape and has an inner surface, at least one elastic lug secured to and extending inwardly from the inner surface of said locking member and being displaceably engageable with said second portion for securing said stop member thereon, said second portion of said expansion member has at least one rack formed therein with said rack extending in the axial direction of said expansion member, said rack having a number of teeth spaced apart in the axial direction of said expansion member and said teeth extending transversely of the axial direction of said expansion member and for only a portion of the circumferential periphery of said expansion member, and said lug on said locking member arranged to interengage in said rack in the space between two adjacent said teeth thereof, and said locking member being rotatable relative to said expansion member so that said lug can be displaced by the rotation movement out of interengagement said rack.

2. Expansion dowel assembly, as set forth in claim 1, wherein said supporting member has surfaces thereon arranged to be engaged by a tool for applying torque thereto.

3. Expansion dowel assembly, as set forth in claim 2, wherein said locking member has surfaces thereon arranged to be engaged by a tool for applying torque thereto for turning said locking member around said second portion of said expansion member.

4. Expansion dowel assembly, as set forth in claim 1, wherein said lug having a wedge-shaped end spaced inwardly from the inner surface of said locking member.

5. Expansion dowel assembly, as set forth in claim 1, wherein said teeth in said rack are inclined from the roots thereof toward the rear end of said expansion member and each said tooth having a longer side and a shorter side with the longer side being located closer to said first portion of said expansion member.

6. Expansion dowel assembly, as set forth in claim 1, wherein said supporting member has a female thread thereon and said locking member has a male thread arranged to interengage said female thread.

7. Expansion dowel assembly, as set forth in claim 1, wherein said second portion of said expansion member has an outwardly projecting flange-like surface adjacent the rear end of said expansion member and the end of said supporting member closer to the rear end of said expansion member in combination with said flange-like surface form bearing surfaces so that a part can be held between them in spaced relation to the surface of a support structure in which the first portion of said expansion member is inserted.

* * * * *